United States Patent [19]

Mutschler

[11] 3,938,899

[45] Feb. 17, 1976

[54] STYLOGRAPH

[76] Inventor: Otto Mutschler, Ludolf-Krehl Str. 21, D-69 Heidelberg, Germany

[22] Filed: May 5, 1975

[21] Appl. No.: 574,320

[30] Foreign Application Priority Data

May 8, 1974 Germany ..... 2422137

[52] U.S. Cl. ..... 401/260

[51] Int. Cl. ..... B43k 8/00

[58] Field of Search ..... 401/258–260

[56] References Cited

UNITED STATES PATENTS

| | | | |
|---|---|---|---|
| 3,424,538 | 1/1969 | Rausch | 401/259 |
| 3,459,486 | 8/1969 | Matschkal | 401/259 |

FOREIGN PATENTS OR APPLICATIONS

| | | | |
|---|---|---|---|
| 1,244,806 | 9/1960 | France | 401/260 |
| 1,906,013 | 9/1970 | Germany | 401/259 |

OTHER PUBLICATIONS

Note Reference B Corresponds to German Pat. No. 1,511,390 7/69.

*Primary Examiner*—Lawrence Charles
*Attorney, Agent, or Firm*—Hans Berman

[57] ABSTRACT

A plunger-mounted pin moves axially in the tubular stylus projecting from the front end of a stylograph barrel. Ink is supplied to the stylus from a reservoir in the barrel through a continuous capillary conduit system partly constituted by an annular gap between the plunger and a feed bar in which the plunger is axially movable. A portion of the conduit system by-passes an air chamber behind the plunger.

7 Claims, 12 Drawing Figures

STYLOGRAPH

This invention relates to stylographs of the type employed by draftsmen for use with India ink, and particularly to a stylograph equipped with an improved ink supply from a reservoir in the stylograph barrel to a stylus axially projecting from the front end of the barrel.

The known stylographs are not entirely satisfactory. When a conventional stylograph is filled with India ink for the first time, it may take several minutes of shaking before ink can flow from the tip of the stylus. Even before this operative condition is reached, ink may be discharged from the conduit normally intended to admit air to the ink reservoir. In some stylographs, the ink reservoir must be kept filled to not much less than one half of its capacity if a continuous ink line is to be drawn. Some known stylographs cannot produce continuous, long ink lines at high speed and are thus unsuited for use in computer-controlled, automatic drafting devices.

It is the primary object of this invention to provide a stylograph having an ink supply system which permits prompt start-up and continuous drawing of uniform lines at high speed. Another object is the avoidance of ink discharge from the air intake openings and the resulting soiling of hands and drafting materials.

With these and other objects in view, the invention provides a stylograph in which a continuous system of capillary conduits connects the ink reservoir in the barrel of the device with the tip of the stylus. More specifically, a portion of the capillary conduit system bridges and by-passes the air chamber necessarily bounded by the plunger carrying a pin which is movably received in the stylus to prevent clogging of the stylus.

Other features, additional objects, and many of the attendant advantages of this invention will readily be appreciated as the same becomes better understood from the following detailed description of preferred embodiments when considered in connection with the appended drawing in which:

FIG. 1 shows a stylograph of the invention in fragmentary side-elevational section;

FIGS. 2, 3, 4, and 5 show the device of FIG. 1 in respective sections on the lines II—II, III—III, IV—IV, and V—V;

Figures 1, 2, 3, 4, 5:
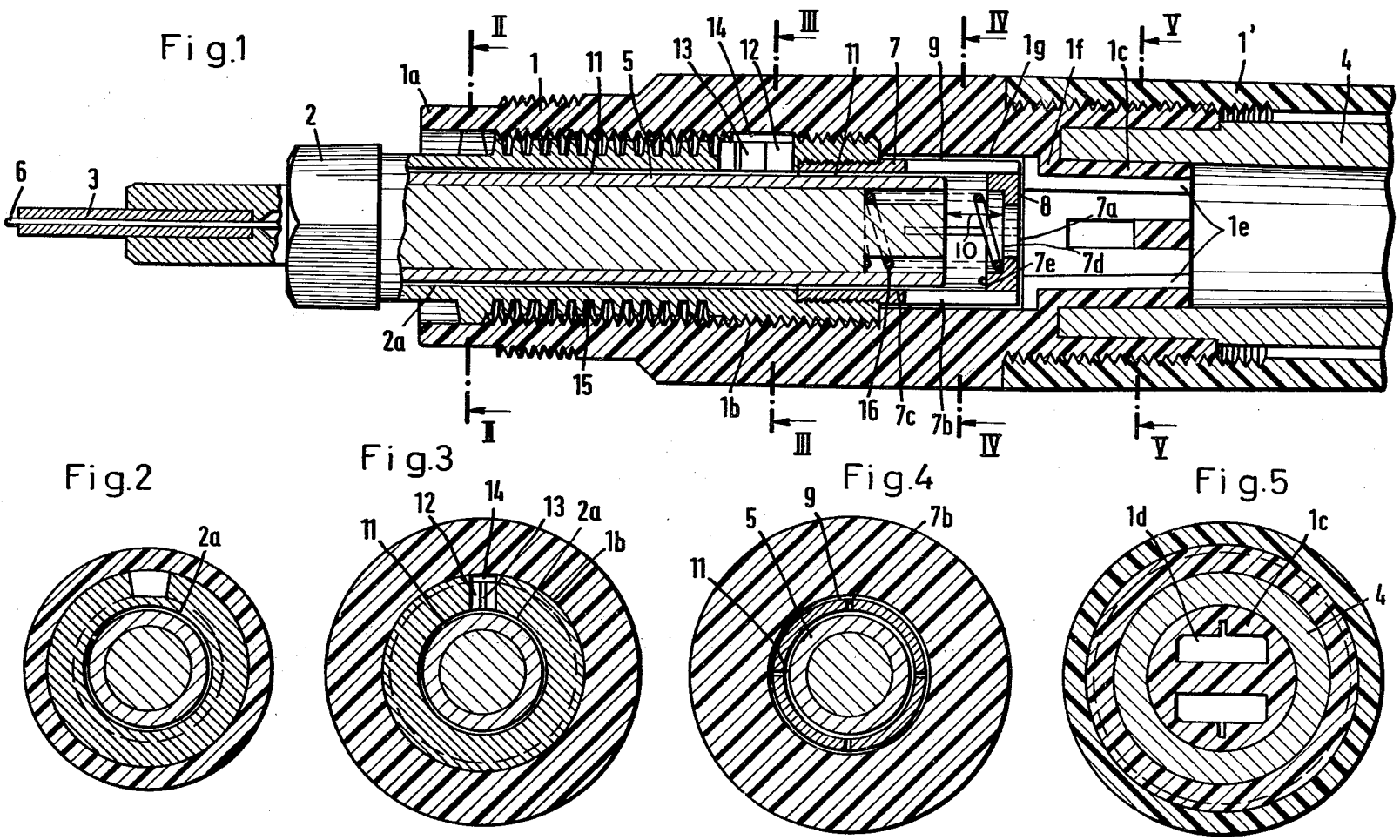

Referring initially to FIG. 1, there is seen a stylograph whose plastic barrel is of generally cylindrical shape and consists of a tubular front part 1 and a rear part 1′, only partly seen and closed in a rearward direction in a conventional manner, not shown. The barrel parts are threadedly connected. A cylindrical front portion 1*a* of the bore in the barrel part 1 receives a feed bar 2 which is secured in the barrel part 1 by threads 1*b*. A tubular stylus 3 coaxially projects forward from the feed bar 2 and communicates with the bore portion 1*a*.

A reduced, generally cylindrical plug 1*c* at the rear end of the barrel part 1 extends from an integral radial flange 1*f* of the barrel part 1 axially into an ink cartridge 4. As is best seen in FIG. 5, the plug 1*c* is formed with two axial passages 1*d* offset in opposite radial directions from a median, axial plane of the plug 1*c*. Capillary axial slots 1*e* communicate with the passages 1*d* over their entire axial lengths. The orifices of the slots 1*e* toward the central portion 1*g* of the bore in the barrel part 1 are enlarged in a radially outward direction to the circumferential wall of the bore portion 1*g*.

The feed bar 2 has a central, smoothly cylindrical bore 2*a* in which a plunger 5 of cylindrical shape is axially movable. The front end of the plunger 5 carries a fine pin 6 movably received in the bore of the stylus 3. A generally cup-shaped retainer 7 threadedly mounted in the enlarged rear end of the bore 2*a* limits rearward movement of the plunger 5 and prevents the plunger from leaving the bore 2*a* when the feed bar 2 is removed from the barrel part 1. The axial bore 7*c* of the retainer 7 has the same cross section as the bore 2*a* so that the plunger 5 is separated from the feed bar 2 and the axial inner wall of the retainer 7 by a uniform, capillary, annular gap 11 extending over the entire length of the plunger.

The outer, radial end face 7*a* of the retainer 7 and the radial front face of the flange 1*f* bound a capillary gap 8 which communicates with the orifices of the slots 1*e* and with four equiangularly distributed axial slots 7*b* in the cylindrical wall of the retainer 7, best seen in FIG. 4. The slots 7*b* axially connect the annular gap 11 with the gap 8. They radially communicate with an annular space 9 between the retainer 7 and the inner wall of the barrel part 1.

In the illustrated position, the plunger 5 is separated from the inner bottom face 7*e* of the cup-shaped retainer 7 by a chamber 10 normally filled with air and communicating with the cartridge 4 through a wide, central opening 7*d* connecting the bottom face 7*e* with the outer end face 7*a* of the retainer and through the passages 1*d* in the plug 1*c*. The stylus 3 is thus connected with the ink cartridge 4 by a continuous, capillary conduit system constituted by the slots 1*e* in the plug 1*c*, the slots 7*b* in the retainer 7, and the annular gap 11. The conduit by-passes the air chamber 10 in all axial positions of the plunger 5. The plunger is normally held in the illustrated position by a helical compression spring 16 whose axial ends are received in recesses of the plunger 5 and of the retainer 7.

Figure 6:
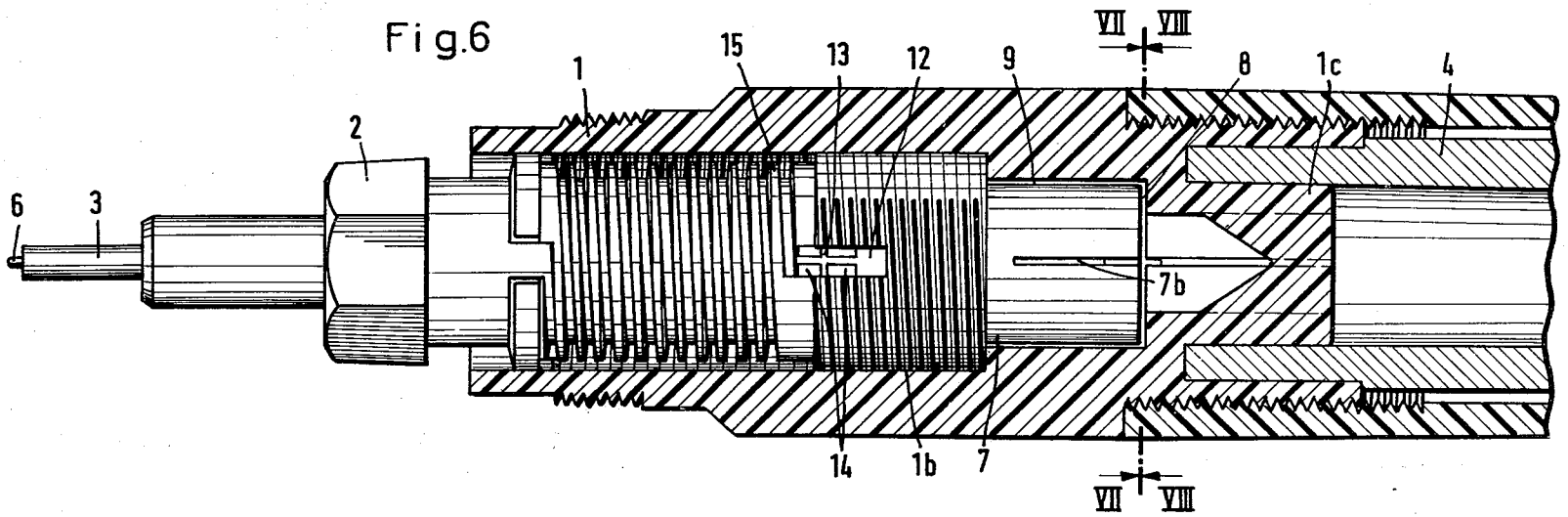
FIG. 6 illustrates the device of FIG. 1 in top plan view and partly in section.
Figure 8:
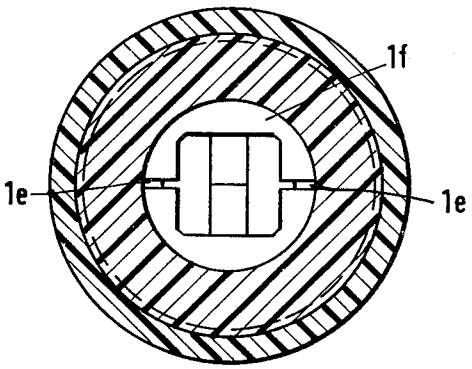
FIGS. 7 and 8 show the device of FIG. 6 in section on the lines VII—VII and VIII—VIII respectively.
Figure 7:
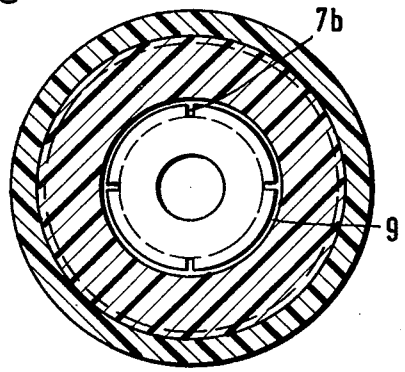
Figure 9:
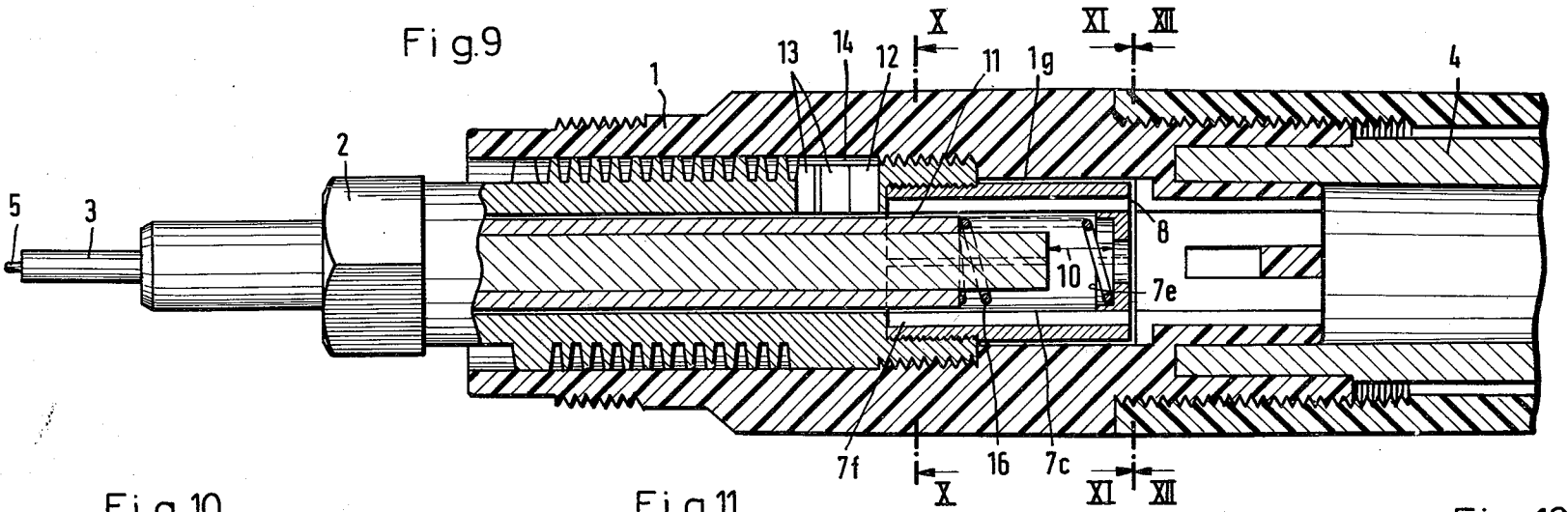
FIG. 9 illustrates a modification of the stylograph of FIG. 1 in a corresponding view.
Figure 12:
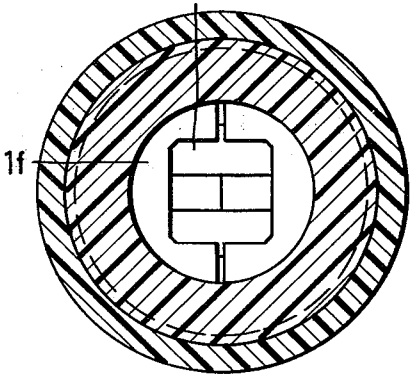
FIGS. 10, 11, and 12 illustrate the device of FIG. 9 in respective sections on the lines X—X, XI—XI, and XII—XII.

The flow of air from the ambient atmosphere into the cartridge 4 is controlled by a metering orifice 14 which communicates with a capillary slot 13 and an air duct 12, and connects the gap 11 with a helical groove 15 in the outer face of the feed bar 2, as is best seen in FIG. 6. The groove leads forward to the atmosphere and retains any excess of ink as is conventional. Air thus can enter the cartridge 4 at a rate sufficient to permit an uninterrupted ink line to be drawn at high speed by the stylus 6, yet the air flow is interrupted instantaneously when ink is not discharged from the stylus or when the pressure in the cartridge and in the communicating air passages rises above ambient pressure, as may occur when the ambient pressure drops during airplane travel or when the temperature of the stylograph rises. Any ink entering the air ducts under such conditions is retained in the groove 15.

The spring 16 is desirable particularly when the stylograph is employed in computer-controlled drafting equipment, but may be omitted in a normally hand-held implement. Any ink film solidified in the gap 11 during an extended period of idleness is broken up when the stylograph is shaken in an axial direction, thereby reciprocating the plunger 5 in the bore 2*a*. As the air chamber 10 expands and contracts during the plunger movement, air is drawn into the cartridge 4 and ink is expelled. When drawing work is interrupted for a relatively short period, a liquid ink film is maintained in the afore-described continuous capillary conduit system between the cartridge 4 and the stylus 3, and the stylograph is immediately ready for use. The pin 6 moves with the plunger 5 to clear the bore of the stylus in the usual manner.

Figure 11:
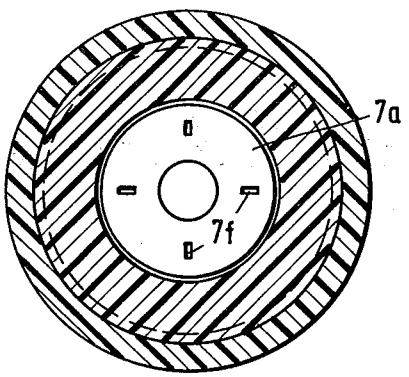
Figure 10:
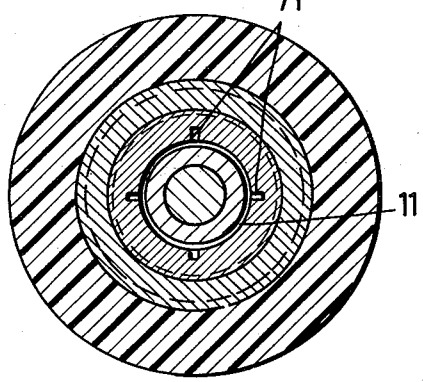

In the modified stylograph shown in FIGS. 9 to 12, the portion of the capillary ink conduit bridging the air chamber 10 is constituted by axial grooves 7*f* in the inner, axial wall of the retainer 7 which are closed in a radially outward direction and communicate with the annular gap 11 in all axial positions of the plunger 5. The grooves 7*f* extend through the radial bottom wall of the retainer 7, as shown in FIG. 10, and terminate in orifices open toward the gap 8, as is best seen in FIG. 11.

Except for minor dimensional variations, the device shown in FIGS. 9 to 12 is not otherwise different from that described above with reference to FIGS. 1 to 8, and it functions in the same manner.

While the invention has been described with reference to a drafting implement employing a cartridge as a reservoir for its India ink supply, other known reservoir types may be employed, and the necessary minor modifications of the stylograph will be obvious to those skilled in the art.

Cup-shaped retainers for the pin-carrying plunger are commonly employed in this art and have known advantages. However, a plug or other element may be used for rearwardly closing the bore of the feed bar, and portions of the capillary conduit connecting the cartridge 4 with the stylus 3 which are formed in the retainer 7 in the illustrated embodiments of the invention may be formed in the barrel to provide a capillary bridge by-passing the air chamber 10.

It should be understood, therefore, that the foregoing disclosure relates only to preferred embodiments of the invention, and that it is intended to cover all changes and modifications of the examples of the invention herein chosen for the purpose of the disclosure which do not constitute departures from the spirit and scope of the invention set forth in the appended claims.

What is claimed is:

1. A stylograph comprising:

a. a tubular barrel member having an axis and being open in one axial direction;

b. a feed bar member formed with an axial bore and fixedly mounted in said barrel member;

c. a tubular stylus mounted on said feed bar member and projecting outward of said barrel member in said one axial direction;

d. a plunger mounted in said bore for axial movement toward and away from a predetermined position;

e. a pin secured on said plunger for joint axial movement and movably received in said stylus;

f. a retainer member mounted on said feed bar member and closing said bore in an axial direction opposite to said one direction, 1. said plunger and said retainer member axially bounding therebetween an air chamber in said bore in said predetermined position of the plunger, said plunger moving inward of said air chamber when moving away from said position thereof, 2. said plunger and said feed bar member radially bounding therebetween an annular gap of capillary dimensions in said bore, said gap axially connecting said air chamber with said stylus in all operative positions of said plunger;

g. means in said barrel member offset from said feed bar member in said opposite direction, and defining an ink reservoir, 1. at least one of said members being formed with a continuous capillary conduit communicating with said air chamber and having axially terminal portions directly communicating with said reservoir and said annular gap, a portion of said conduit extending over the entire axial dimension of said air chamber and by-passing said air chamber; and h. means for admitting ambient air to said air chamber when ink flows from said reservoir to said stylus through said conduit and said gap.

2. A stylograph as set forth in claim 1, further comprising a radial flange in said barrel member, said flange being formed with an axial bore communicating with said reservoir and having a radial face, said retainer member having an end face opposite said face of said flange, said faces axially bounding therebetween a capillary gap constituting a portion of said conduit.

3. A stylograph as set forth in claim 2, wherein said flange is formed with a capillary slot elongated axially inward from said radial face and communicating with said bore, said slot constituting another portion of said conduit, said retainer member being formed with an aperture connecting said air chamber to said bore of the flange.

4. A stylograph as set forth in claim 3, wherein said retainer member is formed with said portion of said conduit.

5. A stylograph as set forth in claim 4, wherein said portion of said conduit passes axially through said retainer member and has an orifice in said end face.

6. A stylograph as set forth in claim 1, further comprising yieldably resilient means biasing said plunger toward said predetermined position.

7. A stylograph as set forth in claim 6, wherein said biasing means include a helical compression spring interposed in said air chamber between said plunger and said retainer member.

* * * * *